US010226877B1

(12) United States Patent
Schmier, II et al.

(10) Patent No.: US 10,226,877 B1
(45) Date of Patent: Mar. 12, 2019

(54) SYSTEMS AND METHODS OF SEPARATING TUBING SLEEVES FROM A TUBING HOLDER

(71) Applicant: The Boeing Company, Chicago, IL (US)

(72) Inventors: Mark A. Schmier, II, Mesa, AZ (US); David J. Delany, Gilbert, AZ (US)

(73) Assignee: THE BOEING COMPANY, Chicago, IL (US)

( * ) Notice: Subject to any disclaimer, the term of this patent is extended or adjusted under 35 U.S.C. 154(b) by 805 days.

(21) Appl. No.: 13/907,682

(22) Filed: May 31, 2013

Related U.S. Application Data

(63) Continuation-in-part of application No. 13/227,593, filed on Sep. 8, 2011, now Pat. No. 8,935,842.

(51) Int. Cl.

| | |
|---|---|
| ***B26D 1/157*** | (2006.01) |
| ***B26D 7/06*** | (2006.01) |
| ***B26D 1/12*** | (2006.01) |
| ***B26D 3/16*** | (2006.01) |

(52) U.S. Cl.
CPC ..... *B26D 7/0666* (2013.01); *B26D 1/12* (2013.01); *B26D 3/16* (2013.01)

(58) Field of Classification Search
CPC ..... B26D 7/1863; B26D 7/1836; B26D 7/18; B26D 7/1854; Y10T 83/0467; Y10T 83/2185
USPC ..... 83/152, 153, 23, 151, 51
See application file for complete search history.

(56) References Cited

U.S. PATENT DOCUMENTS

| | | | | |
|---|---|---|---|---|
| 1,969,696 A | | 8/1934 | Hewton | |
| 3,056,324 A | * | 10/1962 | Lach | B26D 1/245 83/422 |
| 3,180,442 A | | 4/1965 | Pomeroy | |
| 3,238,825 A | * | 3/1966 | Dearsley | A24C 5/476 83/25 |
| 3,312,053 A | | 4/1967 | Hirotokitakamune et al. | |

(Continued)

FOREIGN PATENT DOCUMENTS

| | | |
|---|---|---|
| DE | 102005044188 A1 | 4/2007 |
| EP | 2720006 A1 | 4/2014 |

(Continued)

OTHER PUBLICATIONS

Heat Shrink Cutter: Slice 135: BuyHeatShrink.com, retrieved from the Internet: http://www.buyheatshrink.com/wire-cutter/slice-135-heat-shrink-cutter.htm; 2006-2012 BuyHeatShrink.com, (3 pgs).

(Continued)

*Primary Examiner* — Sean Michalski
*Assistant Examiner* — Fernando Ayala
(74) *Attorney, Agent, or Firm* — Toler Law Group, P.C.

(57) ABSTRACT

A method includes using a feed system to feed a tubing holder toward a cutting system. A plurality of sections of tubing are coupled at intervals along a first spine of the tubing holder, each of the plurality of sections of tubing extending away from the first spine in a direction that is transverse to a feed direction of the feed system. The method also includes using the cutting system to cut a first section of tubing of the plurality of sections of tubing. The cutting system cuts the first section of tubing at a plurality of locations to separate a plurality of subsections of the first section of tubing.

20 Claims, 10 Drawing Sheets

(56) References Cited

U.S. PATENT DOCUMENTS

| | | | | | |
|---|---|---|---|---|---|
| 3,314,339 | A * | 4/1967 | Guffy | B26D 3/085 493/403 |
| 3,406,851 | A | 10/1968 | Sundberg | |
| 3,522,971 | A | 8/1970 | Buschbom | |
| 3,894,731 | A | 7/1975 | Evans | |
| 3,985,852 | A | 10/1976 | Evans | |
| 4,034,450 | A | 7/1977 | Carlomagno et al. | |
| 4,083,268 | A | 4/1978 | Kober | |
| 4,095,926 | A | 6/1978 | Paul | |
| 4,365,400 | A | 12/1982 | Carlomagno | |
| 4,451,965 | A | 6/1984 | Carlomagno | |
| 4,574,440 | A * | 3/1986 | Wirth | H01B 13/344 29/235 |
| 4,651,605 | A * | 3/1987 | Dean, II | B26D 1/385 83/209 |
| 4,655,129 | A | 4/1987 | Wirth et al. | |
| 4,736,501 | A | 4/1988 | Fujimoto | |
| 4,865,895 | A | 9/1989 | Vlamings et al. | |
| 4,868,023 | A | 9/1989 | Ryan et al. | |
| 4,885,964 | A * | 12/1989 | Nielsen | B26D 1/245 83/425.3 |
| 5,021,111 | A | 6/1991 | Swenson | |
| 5,078,001 | A * | 1/1992 | Bakermans | B21D 28/06 242/530 |
| 5,110,638 | A * | 5/1992 | Vogdes | B41M 1/30 101/483 |
| 5,307,940 | A * | 5/1994 | Kanegae | A21C 11/10 209/517 |
| 5,425,307 | A | 6/1995 | Rush et al. | |
| 5,516,221 | A * | 5/1996 | Lake | B41J 11/26 225/99 |
| 5,540,127 | A * | 7/1996 | Binder | H01M 4/16 83/100 |
| 5,651,286 | A | 7/1997 | Champion et al. | |
| 5,791,220 | A | 8/1998 | Liao | |
| 5,865,085 | A | 2/1999 | Vollenweider | |
| 6,089,125 | A | 7/2000 | Cheng | |
| 6,334,253 | B1 | 1/2002 | Cheng | |
| 6,487,949 | B1 | 12/2002 | Dharia | |
| 6,502,488 | B1 | 1/2003 | Taylor | |
| 6,612,216 | B2 | 9/2003 | McGehee et al. | |
| 6,875,304 | B2 | 4/2005 | Schanke et al. | |
| 7,100,486 | B2 | 9/2006 | Akins et al. | |
| 7,469,736 | B2 | 12/2008 | Fries et al. | |
| 7,735,404 | B2 | 6/2010 | Wilk | |
| 8,353,234 | B2 | 1/2013 | Takama et al. | |
| 8,910,553 | B2 | 12/2014 | Catelli | |
| 2003/0219177 | A1 | 11/2003 | Salvaro | |
| 2005/0034818 | A1 | 2/2005 | Prindiville | |
| 2010/0319505 | A1 * | 12/2010 | Celeste | B26D 9/00 83/39 |
| 2011/0239840 | A1 * | 10/2011 | Ohyabu | B26D 1/225 83/505 |
| 2013/0061443 | A1 * | 3/2013 | Fengler | H01B 13/01209 29/426.1 |
| 2015/0231792 | A1 | 8/2015 | Schmier, II et al. | |

FOREIGN PATENT DOCUMENTS

| | | |
|---|---|---|
| JP | S56-006317 | 1/1981 |
| JP | H10199348 | 7/1998 |

OTHER PUBLICATIONS

Model 6100 Heat Shrink Tubing Cutter, retrieved from the Internet: http://www.buyheatshrink.com/wire-cutter/JQ-6100-shrink-tubing-cutter.htm; 2006-2012 BuyHeatShrink.com, (3 pgs).

Slice Model 142-P Adhesive Heat Shrink Cutter; retrieved from the Internet: http://www.buyheatshrink.com/wire-cutter/slice-142-adhesive-heat-shrink-cutter.htm; 2006-2012 BuyHeatShrink.com, (5 pgs).

Extended European Search Report for EP Application No. 15171223.9 from the European Patent Office dated Jan. 19, 2016, 7 pages.

Canadian Examination Report for Application No. 2,788,232 dated May 11, 2018, 4 pgs.

Japanese Office Action for Application No. 2012-196906 dated Oct. 25, 2016, 4 pgs.

Japanese Office Action for Application No. 2012-196906 dated Jul. 5, 2016, 7 pgs.

* cited by examiner

SYSTEMS AND METHODS OF SEPARATING TUBING SLEEVES FROM A TUBING HOLDER

FIELD OF THE DISCLOSURE

The present disclosure is generally related to systems and methods of separating tubing sleeves from a tubing holder.

BACKGROUND

Heat shrink tubing may be utilized for many purposes, including wire and cable identification, insulation, or both. For example, short lengths (or sleeves) of heat shrink tubing may be attached to a tubing holder. The tubing holder may be fed to a printer to print information, such as wire identification information, on the heat shrink tubing. The tubing sleeves may be manually removed by an operator from between the spines of the tubing holder. For example, the tubing sleeves may be separated by hand or manually cut using a scissor or a knife. Each tubing sleeve may be manually positioned on a corresponding wire and heat may be applied to the tubing sleeve to shrink the tubing sleeve in place on the wire.

The manual separation of the tubing sleeves may use hand strength, finger strength, dexterity, and patience. In some applications, such as labeling a complex wiring harness, the manual separation process may be repeated tens or hundreds of times.

SUMMARY

Systems and methods to separate tubing sleeves from a tubing holder are disclosed. The disclosed embodiments include a feed system and a cutting system. The feed system may advance the tubing holder to the cutting system. The cutting system may cut a section of tubing of the tubing holder at a plurality of locations to separate subsections of tubing from the tubing holder. Each of the subsections of tubing may correspond to a heat shrink tubing sleeve. The subsections of tubing may be dispensed to an operator. The operator may use the heat shrink tubing sleeves to label wires, insulate wires, or both.

In a particular embodiment, a method includes using a feed system to feed a tubing holder toward a cutting system. A plurality of sections of tubing are coupled at intervals along a first spine of the tubing holder, each of the plurality of sections of tubing extending away from the first spine in a direction that is transverse to a feed direction of the feed system. The method also includes using the cutting system to cut a first section of tubing of the plurality of sections of tubing. The cutting system cuts the first section of tubing at a plurality of locations to separate a plurality of subsections of the first section of tubing.

In another particular embodiment, an apparatus includes a feed system configured to feed a tubing holder toward a cutting system. A plurality of sections of tubing are coupled at intervals along a first spine of the tubing holder, each of the plurality of sections of tubing extending away from the first spine in a direction that is transverse to a feed direction of the feed system. The apparatus also includes the cutting system configured to cut a first section of tubing of the plurality of sections of tubing. The cutting system cuts the first section of tubing at a plurality of locations to separate a plurality of subsections of the first section of tubing.

In another particular embodiment, a method includes receiving input from an input device at a tubing cutter device. The method also includes, in response to the input, using a feed system of the tubing cutter device to advance a tubing holder by a distance toward a cutting system of the tubing cutter device. A plurality of sections of tubing are coupled at intervals along a first spine of the tubing holder. The distance corresponds to one interval. Each of the plurality of sections of tubing extends away from the first spine in a direction that is transverse to a feed direction of the feed system. The method further includes using the cutting system of the tubing cutter device to cut a first section of tubing of the plurality of sections of tubing. The cutting system cuts the first section of tubing at a plurality of locations to separate a plurality of subsections of the first section of tubing. The method also includes dispensing, substantially simultaneously with one another, the plurality of subsections of tubing from the cutting system to an operator.

Thus, particular embodiments separate tubing sleeves from a tubing holder. Automated separation of the tubing sleeves from the tubing holder may improve efficiency and may reduce cost and effort associated with using the tubing sleeves.

The features, functions, and advantages that have been described can be achieved independently in various embodiments or may be combined in other embodiments, further details of which are disclosed with reference to the following description and drawings.

DETAILED DESCRIPTION

Figure 1:
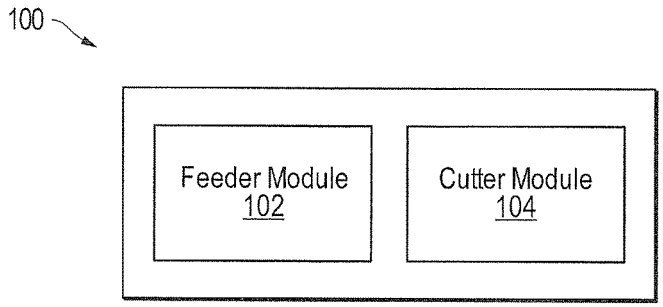
FIG. 1 is a block diagram of a particular embodiment of a system to separate tubing sleeves from a tubing holder.

Referring to FIG. 1, a block diagram of a particular embodiment of a system to separate tubing sleeves from a tubing holder is disclosed and generally designated 100. The system 100 may include a feeder module 102 coupled to, or in communication with, a cutter module 104. During operation, the feeder module 102 may advance a tubing holder toward the cutter module 104. The cutter module 104 may cut a section of tubing at a plurality of locations to separate a plurality of subsections of tubing. The system 100 may dispense, substantially simultaneously with one another, the plurality of subsections from the cutter module 104 to an operator. In a particular embodiment, each of the plurality of subsections that are dispensed substantially simultaneously with one another may include wire designation markings for a particular wire. Operation of the system 100 is further described with reference to FIG. 6.

The system 100 may enable separation of tubing sleeves from a tubing holder. Automated separation of tubing sleeves from the tubing holder may reduce time, cost, and effort associated with separating tubing sleeves from a tubing holder.

Figure 2:
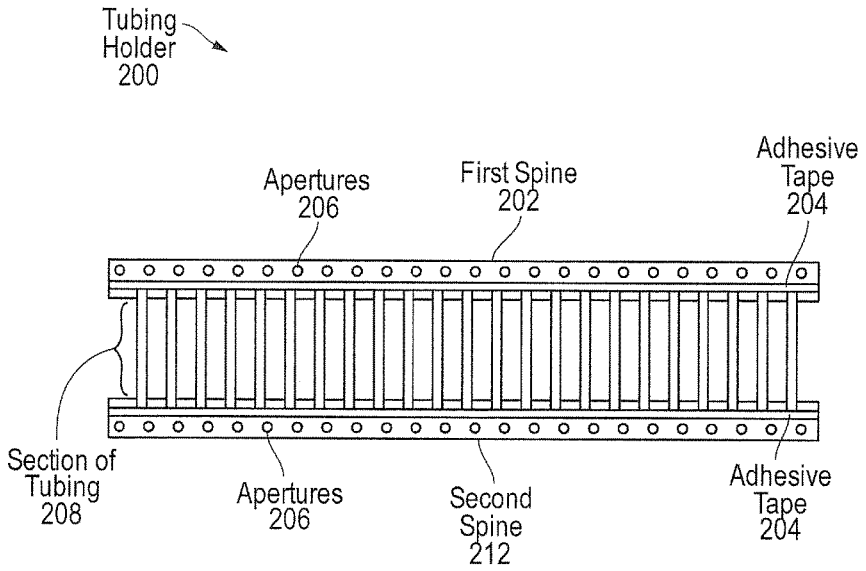
FIG. 2 is a diagram of a particular embodiment of a tubing holder that may be processed by the system of FIG. 1.
Figure 3:
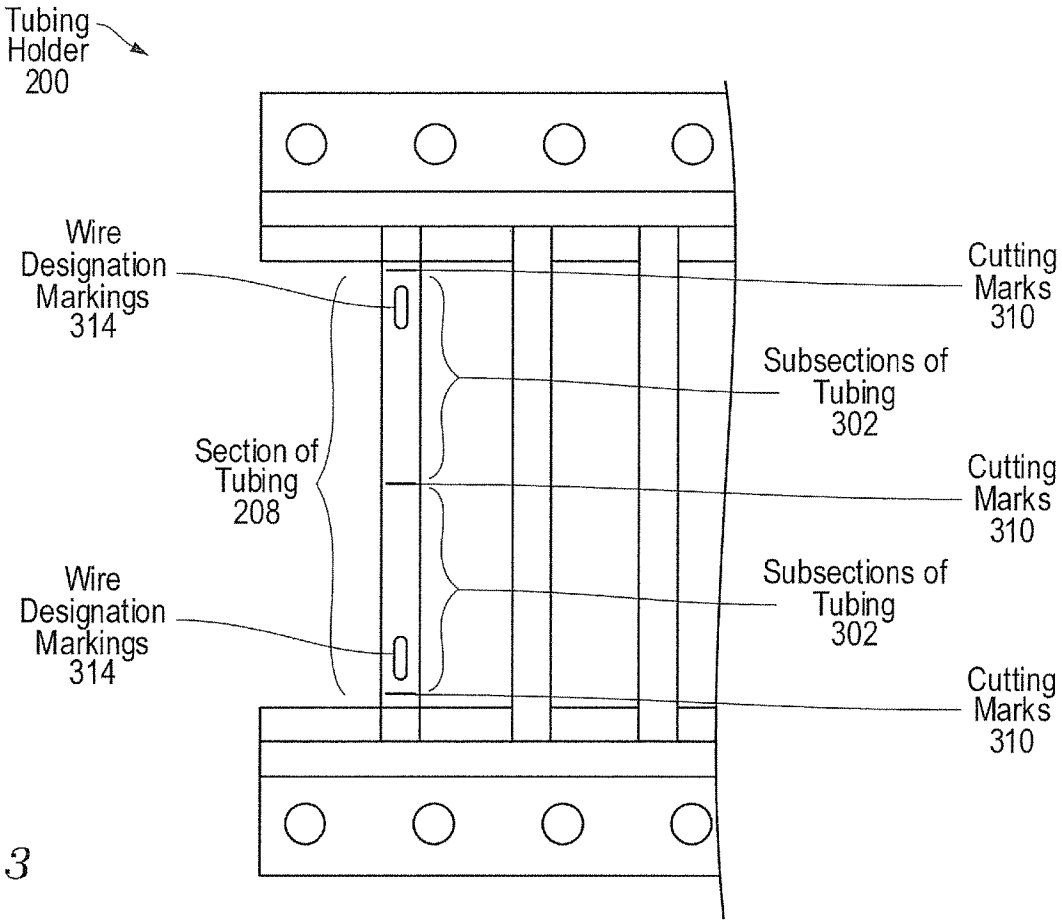
FIG. 3 is another diagram of the tubing holder of FIG. 2.

FIGS. 2 and 3 illustrate a particular embodiment of a tubing holder generally designated 200. The tubing holder 200 may be used by the system 100 of FIG. 1. The tubing holder 200 includes a first spine 202 parallel to a second spine 212. In another embodiment, the tubing holder 200 may include fewer or more than two spines. A plurality of sections of tubing (e.g., including a section of tubing 208) are coupled at intervals along the first spine 202 and along the second spine 212. For example, each of the plurality of sections of tubing may be attached at one end to the first spine 202 and at the other end to the second spine 212 using adhesive tape 204.

In an alternative embodiment, the plurality of sections of tubing may be coupled in another manner to a spine (e.g., the first spine 202, the second spine 212, or both) of the tubing holder. For example, the plurality of sections of tubing may be coupled to a plurality of ribs extending from the spine (e.g., the first spine 202, the second spine 212, or both). As another example, the plurality of sections of tubing may be glued to the spine (i.e., the first spine 202, the second spine 212, or both). The one or more sections may be coupled to the spine when the tubing holder 200 is prepared, manufactured, assembled, etc.

The section of tubing 208 extends away from the first spine 202 and from the second spine 212. For example, the section of tubing 208 is perpendicular to the first spine 202 and to the second spine 212 in a ladder arrangement. The section of tubing 208 includes a plurality of cutting marks 310 indicating locations where the section of tubing 208 may be cut into a plurality of subsections of tubing 302. As illustrated, the section of tubing 208 includes three cutting marks 310 and may be cut into two subsections of tubing 302. In a particular embodiment, the section of tubing 208 may include fewer or more than three cutting marks and may be cut into fewer or more than two subsections. Each subsection may correspond to a heat shrink tubing sleeve. The subsections of tubing 302 may be dispensed (e.g., by the system 100 of FIG. 1) to an operator.

In a particular embodiment, the subsections of tubing 302 may include wire designation markings 314. The wire designation markings 314 may include text, graphics, or both. The subsections of the same section of tubing may include the same wire designation markings 314. In this embodiment, the subsections of tubing 302 may be attached (e.g., by the operator) to each end of a particular wire. In a particular embodiment, a printer may print the wire designation markings 314 on the subsections prior to attachment of the sections of tubing to the tubing holder, subsequent to attachment of the sections to the tubing holder, or both.

As illustrated in FIG. 2, a plurality of apertures 206 are spaced equidistantly along the first spine 202 and along the second spine 212. In a particular embodiment, the plurality of apertures 206 may be differently located, spaced, or both. In a particular embodiment, a spine (e.g., the first spine 202, the second spine 212, or both) may include fewer (e.g., none or one) than a plurality of apertures.

During operation, a feed system (e.g., the feeder module 102 of FIG. 1) may engage the tubing holder 200 using the apertures 206 to feed the tubing holder 200 to a cutting system (e.g., the cutter module 104 of FIG. 1). When a section of tubing (e.g., the section of tubing 208) reaches the cutting system, the cutting system may cut the section of tubing 208 at the locations identified by the cutting marks 310 to separate the subsections of tubing 302 from the tubing holder 200. A feed direction of the feed system (e.g., the feeder module 102 of FIG. 1) may be controlled by a toggle switch. When the toggle switch is activated, the feed direction of the feed system (e.g., the feeder module 102 of FIG. 1) may be reversed to remove the tubing holder 200.

Figure 4:
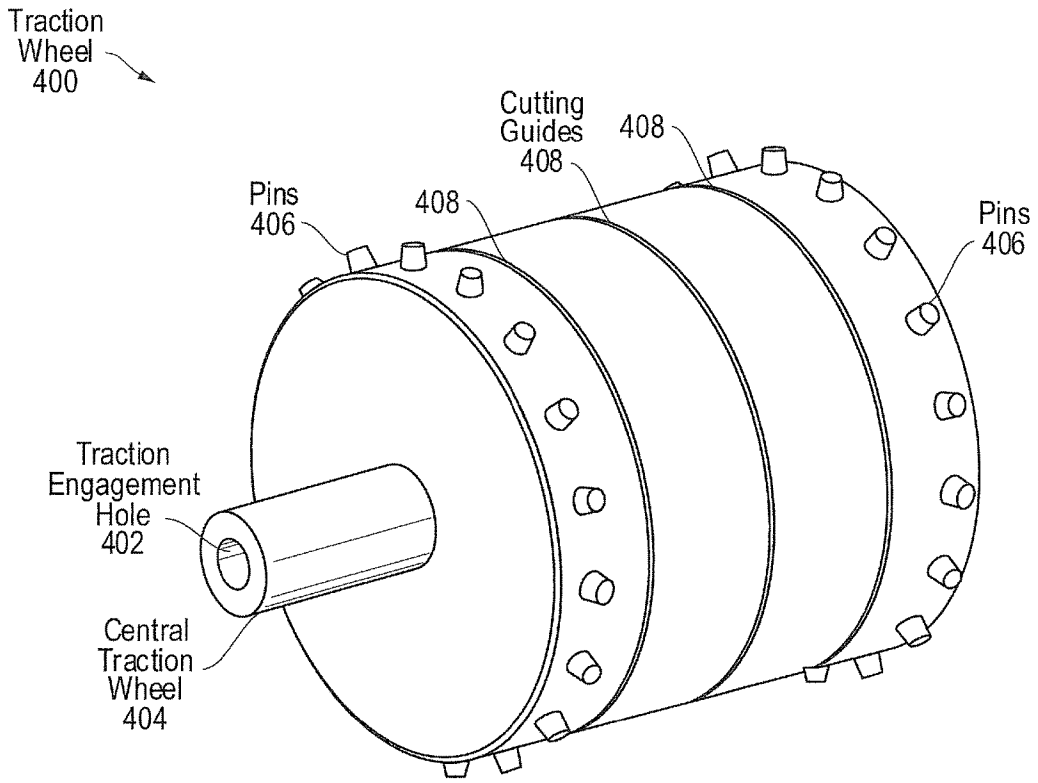
FIG. 4 is a diagram of a particular embodiment of a traction wheel of the system of FIG. 1.

Referring to FIG. 4, a diagram of a particular embodiment of a traction wheel is shown and is generally designated 400. The traction wheel 400 may be included in the feeder module 102 of FIG. 1. The traction wheel 400 includes a central traction wheel 404 (or axle) with a traction engagement hole 402. A plurality of pins 406 project radially outward from the central traction wheel 404. In a particular embodiment, the traction wheel 400 may include fewer (e.g., one or none) than a plurality of pins. The pins 406 may be configured (e.g., sized, shaped, or both) to engage a tubing holder (e.g., the tubing holder 200). To illustrate, one or more of the pins 406 may be configured to engage one or more of the apertures 206 of FIG. 2. The central traction wheel 404 includes a plurality of cutting guides 408. As illustrated, the central traction wheel 404 includes three cutting guides 408. In a particular embodiment, the central traction wheel 404 may include fewer or more than three cutting guides. Each of the cutting guides 408 may provide a track on the traction wheel 400 for a particular cutting blade of a cutting system.

During operation, the traction wheel 400 may advance a tubing holder (e.g., the tubing holder 200 of FIG. 2) toward a cutting system (e.g., the cutter module 104 of FIG. 1). For example, one or more of the pins 406 may engage one or more of the apertures 206 of FIG. 2. The traction wheel 400 may be rotatable about the traction engagement hole 402. As the traction wheel 400 is rotated, the one or more of the pins 406 may engage the one or more of the apertures 206 and may pull the tubing holder 200 in the direction of rotation of the traction wheel 400 towards the cutting system. When rotated in a first (e.g., forward) direction, the traction wheel 400 may advance the tubing holder 200 towards the cutting system. When rotated in a second (e.g., reverse) direction, the traction wheel 400 may move the tubing holder 200 away from the cutting system. In a particular embodiment, the traction wheel 400 may be rotated using an electric motor that engages the traction engagement hole 402. In a particular embodiment, the traction wheel 400 may be driven by, for example, a non-electric motor, a hand crank, etc. In a particular embodiment, the traction wheel 400 may use vacuum pressure or may rely on frictional forces to engage the tubing holder 200. In a particular embodiment, the feed system (e.g., the feeder module 102 of FIG. 1) may utilize a different manner of engaging the tubing holder 200 rather than using the traction wheel 400, such as a chute system, a belt system, a moving clamp, etc.

Thus, the traction wheel 400 may feed the tubing holder 200 to the cutting system (e.g., the cutter module 104 of FIG. 1). Automated feeding of the tubing holder 200 may increase efficiency and reduce cost of separating the tubing sleeves from the tubing holder 200.

Figure 5:
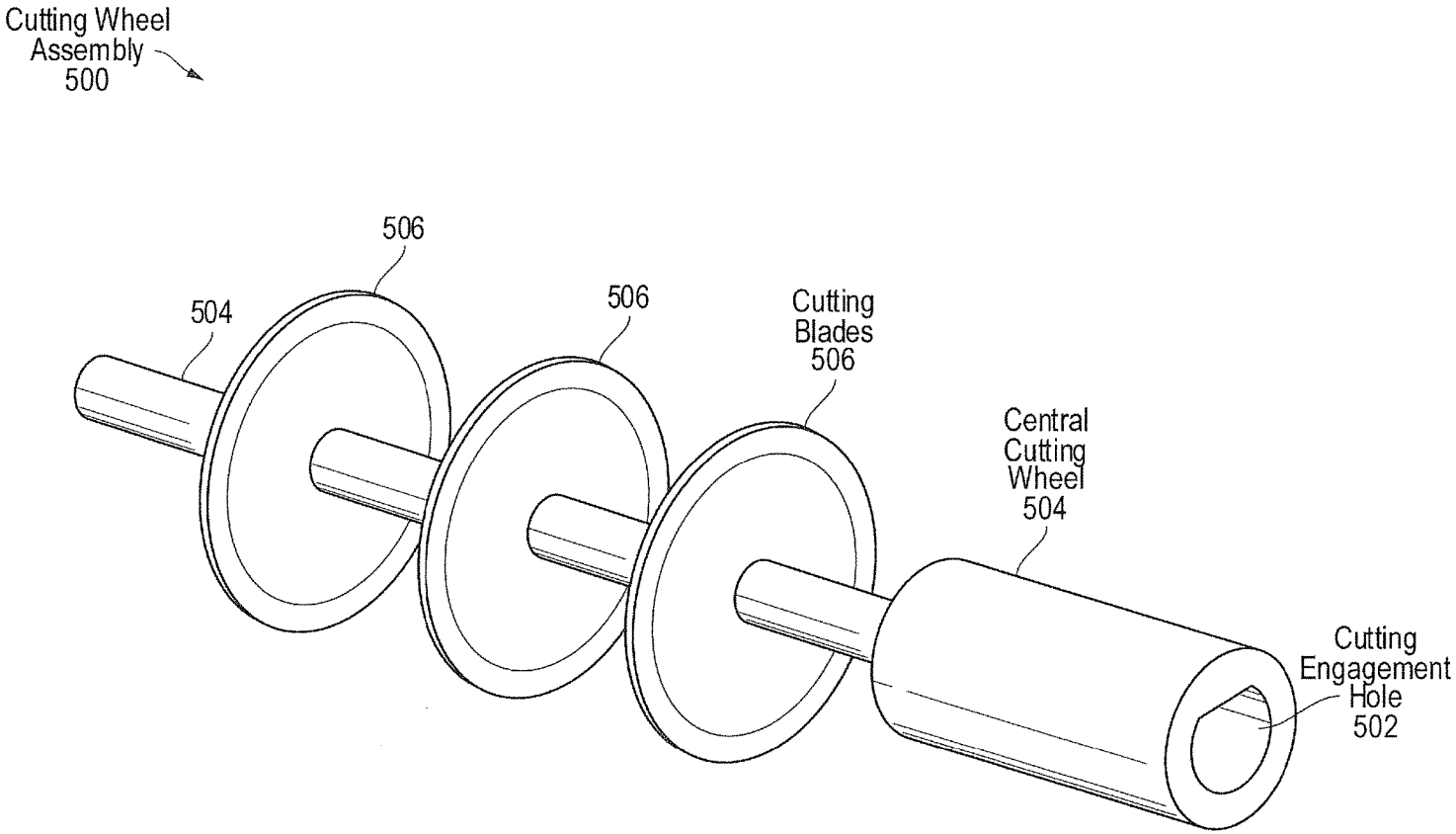
FIG. 5 is a diagram of a particular embodiment of a cutting wheel assembly of the system of FIG. 1.

Referring to FIG. 5, a diagram of a particular embodiment of a cutting wheel assembly is shown and is generally designated 500. The cutting wheel assembly 500 may be included in the cutter module 104 of FIG. 1. The cutting wheel assembly 500 includes a central cutting wheel 504 (or axle) with a cutting engagement hole 502. A plurality of cutting blades 506 extend radially outward from the central cutting wheel 504. As illustrated in FIG. 5, the cutting wheel assembly 500 includes three cutting blades 506. In a particular embodiment, the cutting wheel assembly 500 may include fewer or more than three cutting blades.

During operation, the cutting wheel assembly 500 may cut tubing sleeves from a tubing holder (e.g., the tubing holder 200) as a feed system (e.g., the feeder module 102 of FIG. 1 or the traction wheel 400 of FIG. 4) advances the tubing holder 200 toward the cutting wheel assembly 500. The cutting wheel assembly 500 may be rotatable. As the cutting wheel assembly 500 rotates, the cutting blades 506 may cut a section of tubing (e.g., the section of tubing 208) as the section of tubing 208 passes through the cutting blades 506. The cutting force may separate subsections of the section of tubing 208 from the tubing holder 200. For example, the cutting force may cut the section of tubing 208 at a plurality of locations indicated by the cutting marks 310, separating the subsections of tubing 302 from the tubing holder 200.

In a particular embodiment, an electric motor may rotate the cutting wheel assembly 500 by engaging the cutting engagement hole 502. In a particular embodiment, the cutting wheel assembly 500 may be driven by, for example, a non-electric motor, a hand crank, etc.

In a particular embodiment, the cutting system (e.g., the cutter module 104 of FIG. 1) may utilize a different manner of cutting the section of tubing 208 rather than using the cutting wheel assembly 500. For example, the cutting system may utilize a continuous stream or blast of compressed air to cut the section of tubing 208. As another example, the cutting system may utilize a laser system or a wire system to cut the section of tubing 208. As another example, the cutting system may utilize a wedge-shaped cutter to cut the section of tubing 208.

Thus, the cutting wheel assembly 500 may receive a section of tubing (e.g., the section of tubing 208) of the tubing holder 200 fed by the traction wheel 400 and may cut the section of tubing 208 at a plurality of locations to separate the subsections of tubing 302 from the tubing holder 200. Automated cutting of the section of tubing 208 may increase efficiency and reduce cost of separating the tubing sleeves from the tubing holder 200.

Figure 6:
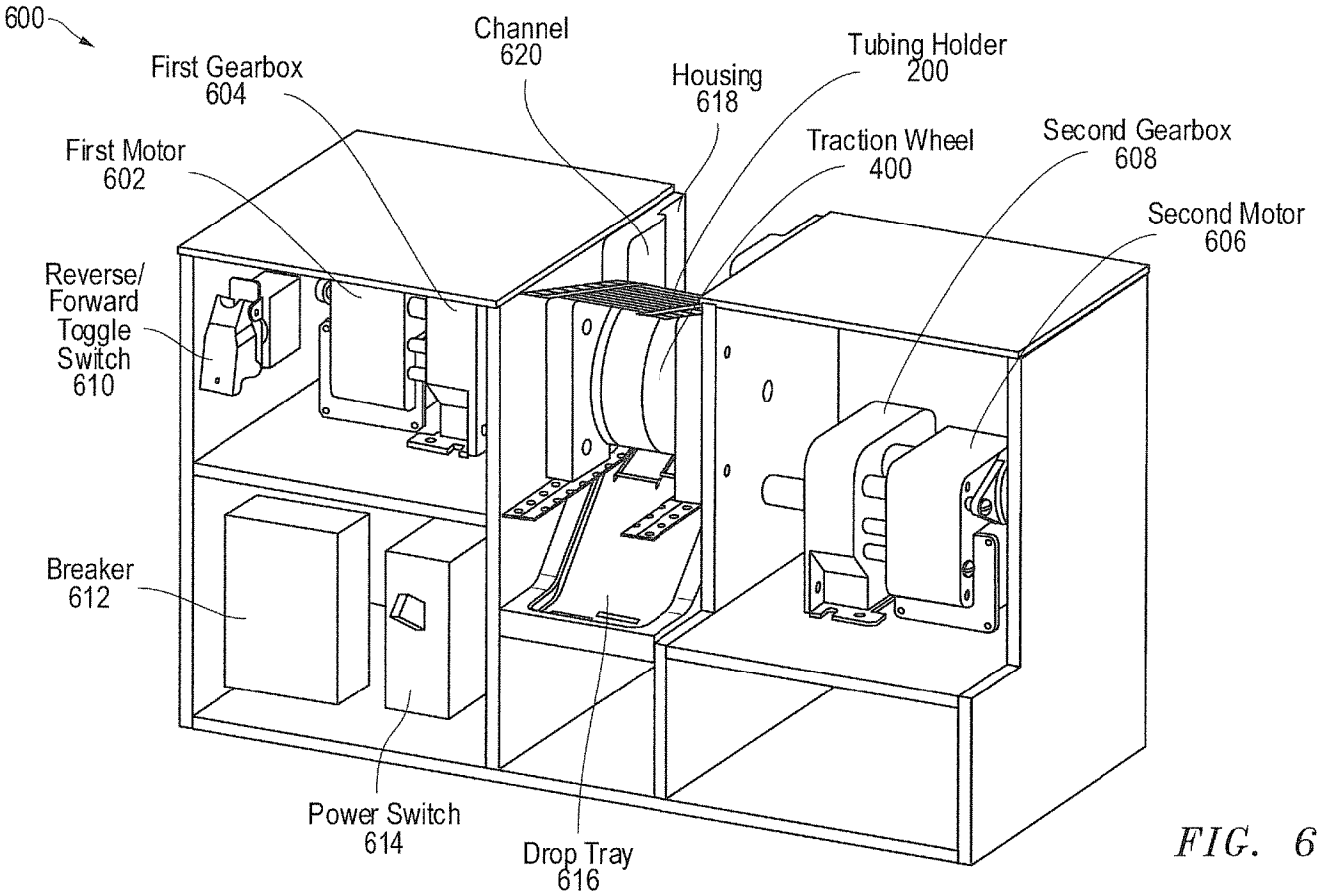
FIG. 6 is a perspective view of an apparatus that may be included in the system of FIG. 1.
Figure 7:
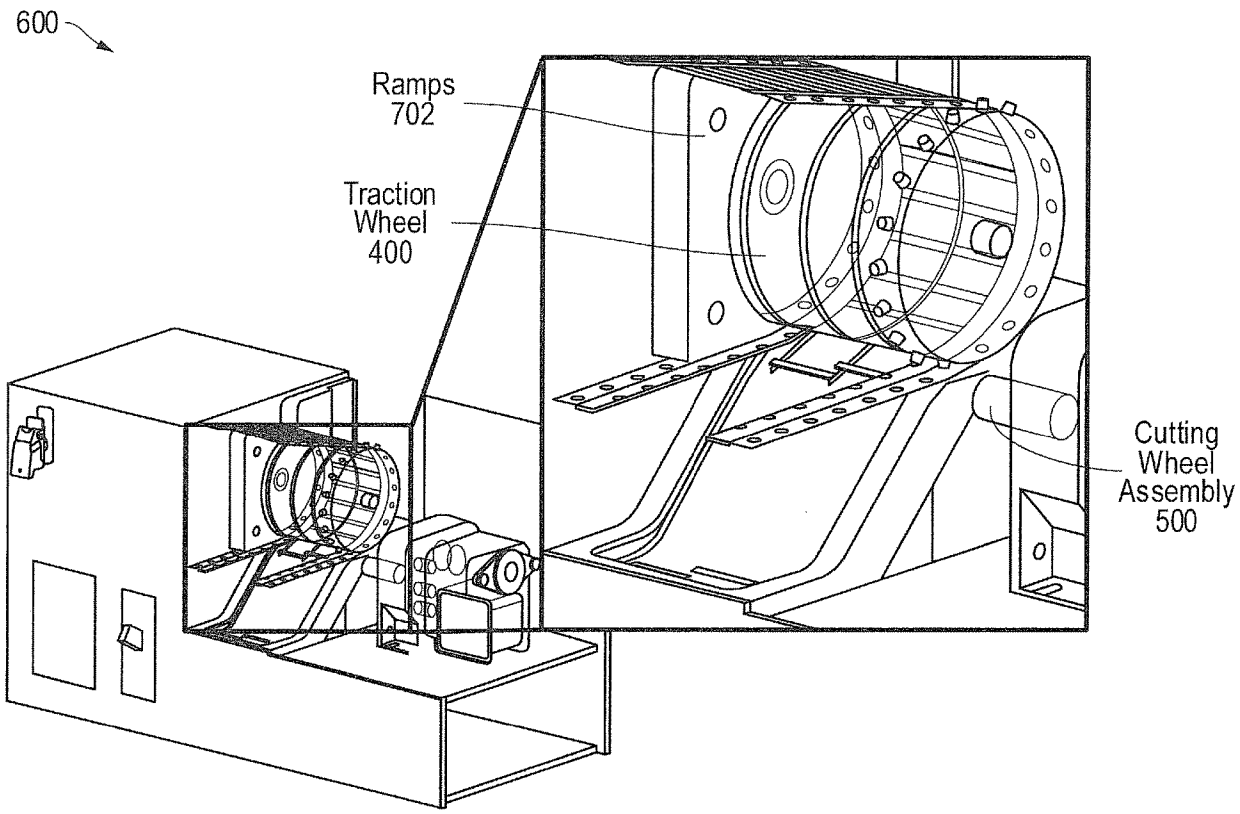
FIG. 7 is another perspective view of the apparatus of FIG. 6.

FIGS. 6 and 7 illustrate a particular embodiment of an apparatus generally designated 600. The apparatus 600 may include, may be included in, or may correspond to the system 100 of FIG. 1. The apparatus 600 is illustrated in FIGS. 6-7 with a removed cover. The apparatus 600 includes the traction wheel 400 of FIG. 4 coupled to a first motor 602 and a first gearbox 604. A housing 618 and the traction wheel 400 cooperatively define a channel 620 through which a tubing holder (e.g., the tubing holder 200 of FIG. 2) may travel when propelled by the traction wheel 400. The apparatus 600 includes the cutting wheel assembly 500 of FIG. 5 coupled to a second motor 606 and a second gearbox 608. The apparatus 600 may include a drop tray 616. The apparatus 600 may include a reverse/forward toggle switch 610 that may control a direction of rotation of the traction wheel 400. The apparatus 600 may include a breaker 612 and a power switch 614.

During operation, a tubing holder (e.g., the tubing holder 200 of FIG. 2) may be positioned in the channel 620 (e.g., by an operator) such that the traction wheel 400 engages the tubing holder 200. For example, ramps 702 may be utilized (e.g., by the operator) to position the tubing holder 200 in the channel 620. One or more of the projecting pins 406 of FIG. 4 may engage one or more of the apertures 206 of FIG. 2. A first position (e.g., up) of the reverse/forward toggle switch 610 may indicate a first direction (e.g., forward) of rotation of the traction wheel 400. When the power switch 614 is activated (e.g., is in an "on" position), the traction wheel 400 and the cutting wheel assembly 500 may begin rotating. One or more cutting blades 506 may be in contact with the traction wheel 400 as the cutting blades 506 and the traction wheel 400 rotate. For example, the cutting blades 506 may be in contact with the traction wheel 400 at a portion of the cutting guides 408. As the traction wheel 400 rotates in the first direction, the one or more of the projecting pins 406 engaging the one or more of the apertures 206 may advance the tubing holder 200 towards the cutting wheel assembly 500. When a section of tubing (e.g., the section of tubing 208 of FIG. 2) reaches the cutting wheel assembly 500, the cutting blades 506 may cut the section of tubing 208 at a plurality of locations (e.g., the plurality of locations indicated by the cutting marks 310 of FIG. 3) to separate a plurality of subsections of tubing (e.g., the subsections of tubing 302 of FIG. 2) from the tubing holder 200. The apparatus 600 may dispense the subsections of tubing 302 substantially simultaneously with one another in the drop tray 616.

A second position of the reverse/forward toggle switch 610 may indicate a second direction (e.g., reverse) of rotation of the traction wheel 400. As the traction wheel 400 rotates in the second direction, the tubing holder 200 may move away from the cutting wheel assembly 500 and may be removed (e.g., by the operator). When the power switch 614 is deactivated (e.g., is in an "off" position), the traction wheel 400 and the cutting wheel assembly 500 may stop rotating.

In a particular embodiment, the first motor 602 may drive rotation of the traction wheel 400 via the first gearbox 604. The first gearbox 604 may control a speed of rotation of the traction wheel 400. In another embodiment, the traction wheel 400 may be driven directly by the first motor 602. The speed of rotation of the traction wheel 400 may control a speed of processing the tubing holder 200 through the apparatus 600 (e.g., the speed of cutting tubing sleeves from the tubing holder 200). In a particular embodiment, a speed of the first motor 602, and thus the speed of rotation of the traction wheel 400, may be variably controlled by an operator. In another particular embodiment, the speed of rotation of the traction wheel 400 may be fixed.

In a particular embodiment, the second motor 606 may drive rotation of the cutting wheel assembly 500 via the second gearbox 608. The second gearbox 608 may control a speed of rotation of the cutting wheel assembly 500. In another embodiment, the cutting wheel assembly 500 may be driven directly by the second motor 606. The speed of rotation of the cutting wheel assembly 500 may control a speed of processing the tubing holder 200 through the apparatus 600 (e.g., the speed of cutting tubing sleeves from the tubing holder 200). In a particular embodiment, a speed of the second motor 606, and thus the speed of rotation of the cutting wheel assembly 500, may be variably controlled by an operator. In a particular embodiment, the speed of rotation of the cutting wheel assembly 500 may be fixed. Different diameters of the cutting blades 506 of FIG. 5 may be used to change the speed of processing the tubing holder 200.

Thus, the apparatus 600 may cut a section of tubing of the tubing holder 200 in turn as the tubing holder 200 advances through the apparatus 600. A speed of processing the tubing holder 200 may be controlled by an operator. The automatic separation of the tubing sleeves from the tubing holder 200 may improve efficiency and reduce cost associated with using the tubing sleeves.

Figure 8:
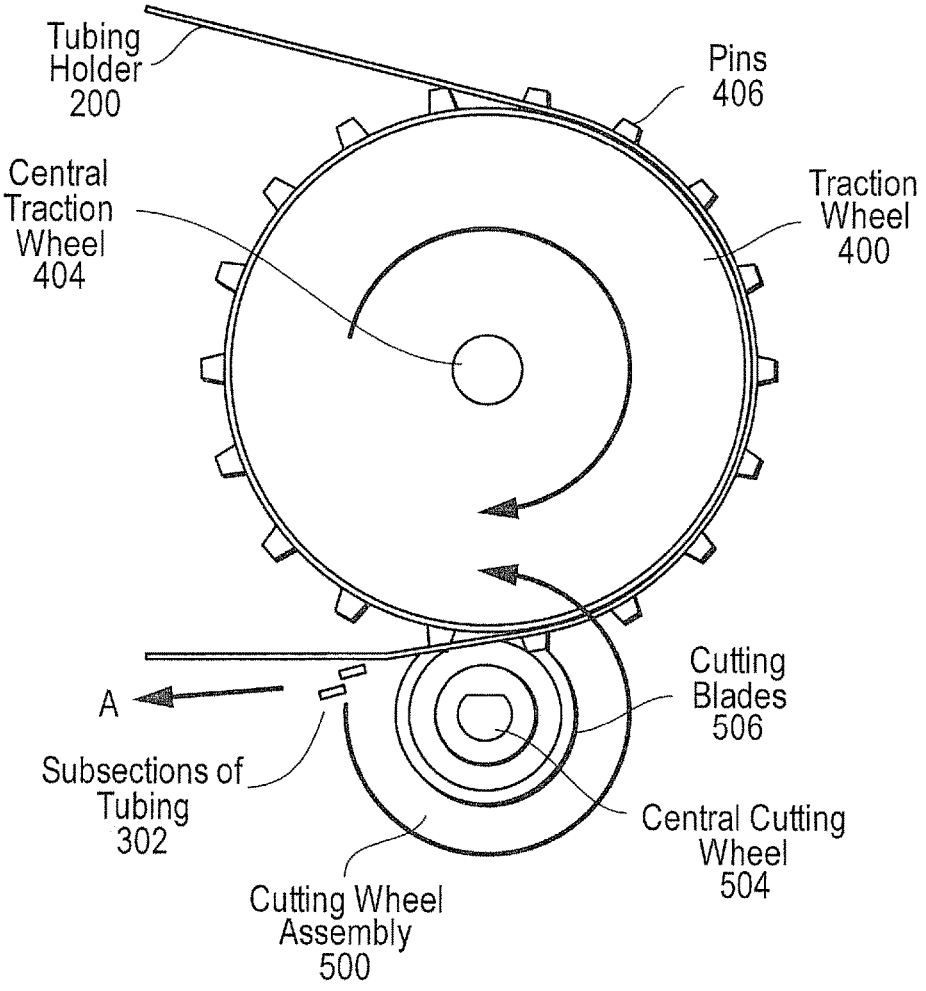
FIG. 8 is a sectional view of the apparatus of FIG. 6.

Referring to FIG. 8, a sectional view of the apparatus 600 of FIGS. 6 and 7 is shown. During operation, the traction wheel 400 may rotate in a first direction (e.g., clock-wise) and the cutting wheel assembly 500 may rotate in an opposite direction (e.g., anti-clockwise). As the traction wheel 400 rotates and advances a tubing holder (e.g., the tubing holder 200 of FIG. 2) towards the cutting wheel assembly 500, the cutting blades 506 may cut a section of tubing (e.g., the section of tubing 208 of FIG. 2) at a plurality of locations to separate a plurality of subsections of tubing (e.g., the subsections of tubing 302 of FIG. 3) from the tubing holder 200.

Thus, the traction wheel 400 and the cutting wheel assembly 500 may operate cooperatively to separate the subsections of tubing 302 from the tubing holder 200.

Figure 9:
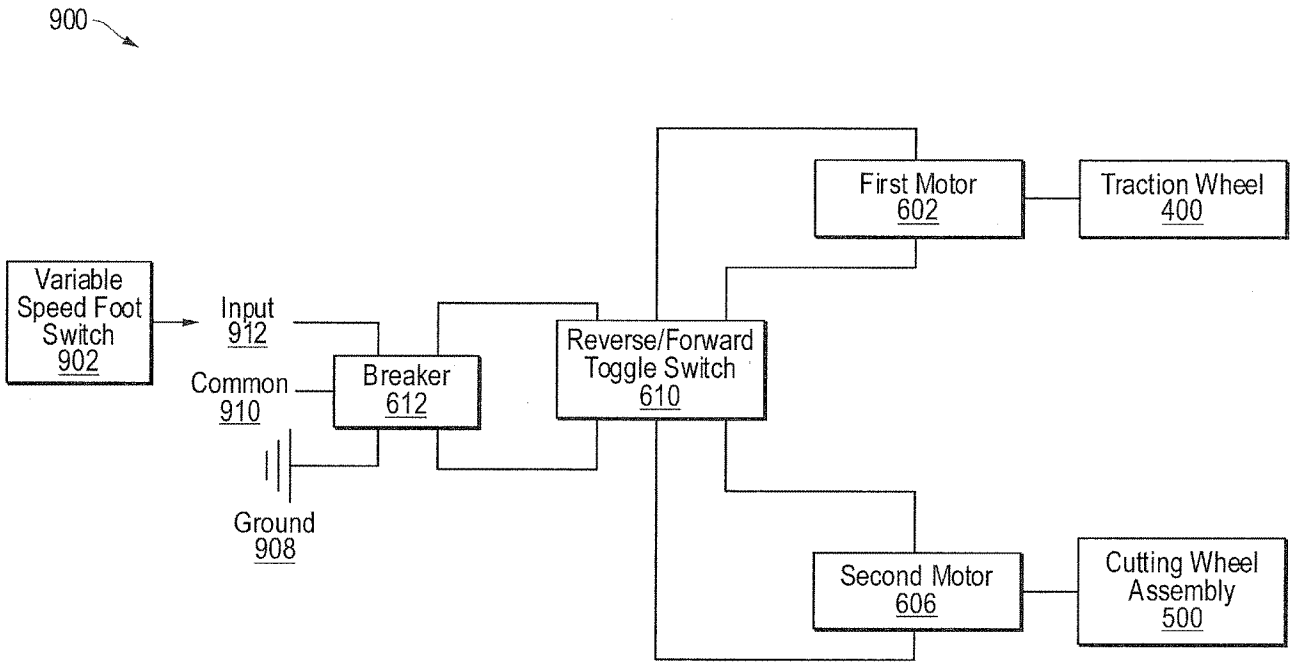
FIG. 9 is a diagram of another particular embodiment of a system to separate tubing sleeves from a tubing holder.

Referring to FIG. 9, a diagram of another particular embodiment of a system to separate tubing sleeves from a tubing holder is shown and is generally designated 900. The system 900 includes a variable speed foot switch 902 coupled to a first motor 602 and to a second motor 606, via a reverse/forward toggle switch 610 and a breaker 612. The breaker 612 is also coupled to ground 908 and to a common line 910. The reverse/forward toggle switch 610 is coupled, via the first motor 602, to the traction wheel 400. In addition, the reverse/forward toggle switch 610 is coupled, via the second motor 606, to the cutting wheel assembly 500.

During operation, an operator may activate the variable speed foot switch 902. For example, the operator may use a foot to depress the variable speed foot switch 902. Upon activation, the variable speed foot switch 902 may send an input 912 to a motor (e.g., the first motor 602, the second motor 606, or both).

In a particular embodiment, the motor (e.g., the first motor 602, the second motor 606, or both) may operate for a particular time duration each time the variable speed foot switch 902 is activated. For example, the first motor 602 may rotate the traction wheel 400 during the particular time duration to advance the tubing holder 200 by a particular distance in response to the input 912. A plurality of sections of tubing may be coupled at intervals along a spine of the tubing holder. The particular distance that the tubing holder 200 is advanced may correspond to one interval. The traction wheel 400 may advance the tubing holder 200 by one section of tubing. Thus, pressing the variable speed foot switch 902 once may provide input (e.g., the input 912) to advance the tubing holder 200 by one interval and to cut one tubing section (e.g., the tubing section 208 of FIG. 2) into subsections (e.g., the subsections of tubing 302 of FIG. 3).

In an alternative embodiment, the motor (e.g., the first motor 602, the second motor 606, or both) may operate substantially continuously while the variable speed foot switch 902 is activated. In this embodiment, a speed of the motor (e.g., the first motor 602, the second motor 606, or both) may be responsive to a distance that the variable speed foot switch 902 is depressed. A value of the input 912 may vary based on the distance that the variable speed foot switch 902 is depressed. For example, the input 912 may have a first value when the variable speed foot switch is depressed a first distance and may have a second value (e.g., a larger value) when the variable speed foot switch is depressed a greater distance. The motor (e.g., the first motor 602, the second motor 606, or both) may have a lower speed in response to receiving the first value of the input 912, as compared to receiving the second value of the input 912. The speed of the first motor 602 may control a speed of rotation of the traction wheel 400 and the speed of the second motor 606 may control a speed of rotation of the cutting wheel assembly 500. Hence, the speed of rotation of the traction wheel 400, the cutting wheel assembly 500, or both, may be responsive to the input 912.

Although, the input 912 is described herein in terms of values, in a particular embodiment the input 912 may be electromechanical. For example, depressing the variable speed foot switch 902 may activate a switch that provides power to a motor (e.g., the first motor 602, the second motor 606, or both) for a predetermined time or number of revolutions of the motor. As another example, depressing the variable speed foot switch 902 may activate a variable resistor to control speed by changing voltage provided to a motor (e.g., the first motor 602, the second motor 606, or both).

In a particular embodiment, the input 912 may be received by the motor (e.g., the first motor 602, the second motor 606, or both) via the breaker 612 and via the reverse/forward toggle switch 610. If a current received by the breaker 612 exceeds a first threshold, the breaker 612 may interrupt the current to protect the system 900 from overload. The reverse/forward toggle switch 610 may control a direction of rotation of a motor (e.g., the first motor 602, the second motor 606, or both). For example, when the reverse/forward toggle switch 610 is in a first position (e.g., "up"), the direction of rotation of the motor (e.g., the first motor 602, the second motor 606, or both) may be forward, and when the reverse/forward toggle switch 610 is in a second position (e.g., "down"), the direction of rotation of the motor (e.g., the first motor 602, the second motor 606, or both) may be reversed. The direction of rotation of the first motor 602 may control a direction of rotation of the traction wheel 400, and the direction of rotation of the second motor 606 may control a direction of rotation of the cutting wheel assembly 500. A first direction of rotation of the traction wheel 400 may advance a tubing holder (e.g., the tubing holder 200) towards the cutting wheel assembly 500, and a second direction of the traction wheel 400 may move the tubing holder 200 away from the cutting wheel assembly 500.

In a particular embodiment, the first motor 602, the second motor 606, or both, may include a single phase, 115 volts alternating current (VAC), 50/60 hertz (Hz) motor. In a particular embodiment, a diameter of the traction wheel 400 may be approximately 2.87 measurement units. As a result, an arc length of the traction wheel 400 may be approximately 9.02 measurement units (i.e., $\pi$*diameter). The traction wheel 400 may have a maximum speed of 100 rotations per minute (RPM). Hence, the tubing holder 200 may advance a maximum of approximately 902 measurement units per minute (i.e., arc length*speed). In a particular embodiment, a diameter of the cutting wheel assembly 500 may be approximately 0.98 measurement units. As a result, an arc length of the cutting wheel assembly 500 may be approximately 3.10 measurement units (i.e., $\pi$*diameter). The cutting wheel assembly 500 may have a maximum speed of 200 RPM. Hence, the cutting wheel assembly 500 may process a maximum of approximately 620 measurement units of the tubing holder 200 per minute.

Thus, the traction wheel 400 and the cutting wheel assembly 500 may cooperatively process the tubing holder 200 and separate tubing sleeves from the tubing holder 200. Automatic separation of the tubing sleeves may reduce cost and increase efficiency associated with separating the tubing sleeves.

Figure 10:
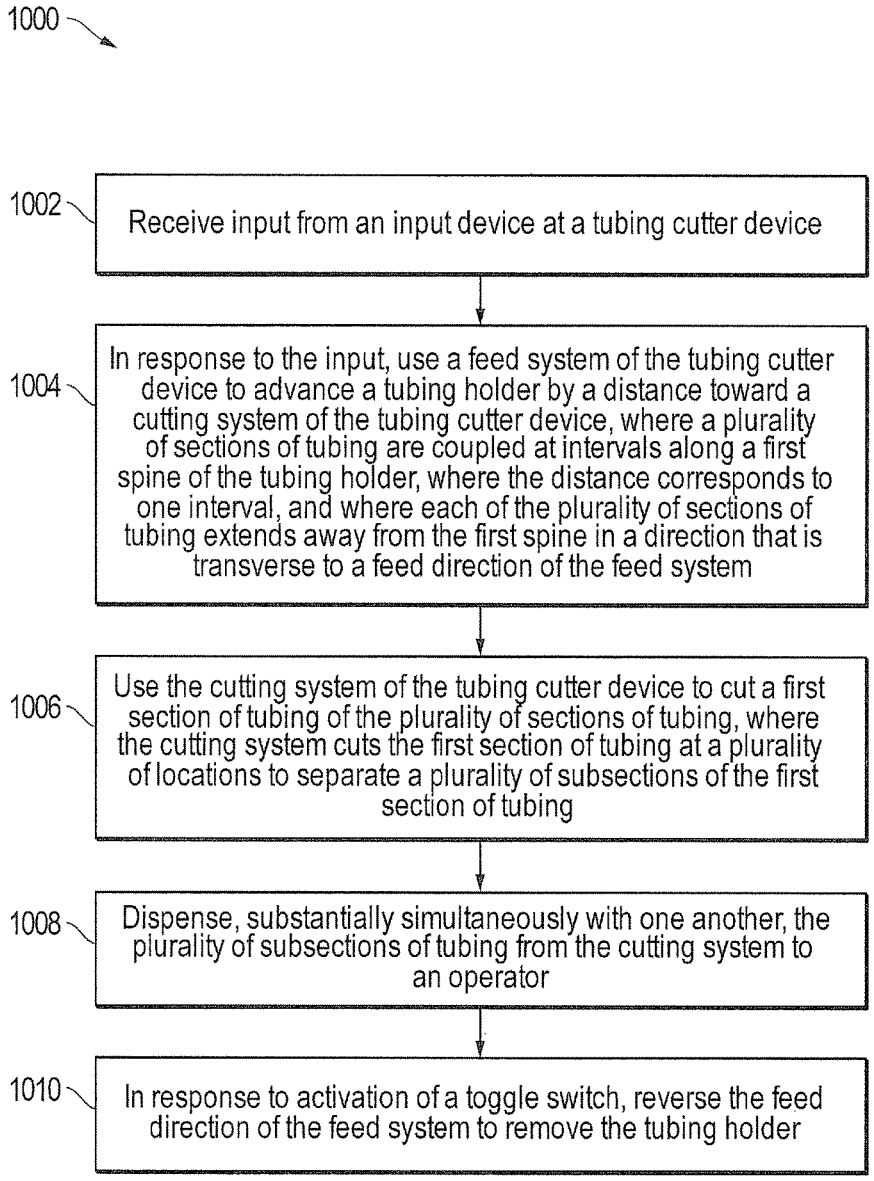
FIG. 10 is a flow chart illustrating a particular embodiment of a method of separating tubing sleeves from a tubing holder.

Referring to FIG. 10, a flow chart of a particular illustrative embodiment of a method of separating tubing sleeves from a tubing holder is shown and is generally designated 1000. The method 1000 of FIG. 10 may be executed by the system 100 of FIG. 1, the apparatus 600 of FIGS. 6-7, the system 900 of FIG. 9, or a combination thereof.

The method 1000 may include receiving input from an input device at a tubing cutter device, at 1002. For example, the apparatus 600 of FIGS. 6-7 may receive an input (e.g., the input 912) from the variable speed foot switch 902. In a particular embodiment, the input device may include a switch, a computing device, a handheld device, a mobile device, or a combination thereof.

The method 1000 may also include, in response to the input, using a feed system of the tubing cutter device to advance a tubing holder by a distance toward a cutting system of the tubing cutter device, at 1004. A plurality of sections of tubing may be coupled at intervals along a first spine of the tubing holder. Each of the plurality of sections of tubing may extend away from the first spine in a direction that is transverse to a feed direction of the feed system. For example, the apparatus 600 may use the traction wheel 400 of FIG. 4 to advance the tubing holder 200 by a particular distance toward the cutting wheel assembly 500 of FIG. 5. A plurality of sections of tubing may be coupled at intervals along the first spine 202 of the tubing holder 200. The particular distance may correspond to one interval.

The method 1000 may further include using the cutting system of the tubing cutter device to cut a first section of tubing of the plurality of sections of tubing, at 1006. The cutting system may cut the first section of tubing at a plurality of locations to separate a plurality of subsections of the first section of tubing. For example, the apparatus 600 may use the cutting wheel assembly 500 to cut the section of tubing 208 of FIG. 2 at a plurality of locations to separate the subsections of tubing 302 of FIG. 3 from the tubing holder 200.

The method 1000 may also include dispensing, substantially simultaneously with one another, the plurality of subsections of tubing from the cutting system to an operator, at 1008. For example, the apparatus 600 may dispense, substantially simultaneously with one another, the subsections of tubing 302 from the cutting wheel assembly 500 to an operator.

The method 1000 may further include reversing the feed direction of the feed system to remove the tubing holder in response to activation of a toggle switch, at 1010. For example, the apparatus 600 of FIGS. 6-7 may reverse the feed direction of the traction wheel 400 to remove the tubing holder 200 in response to activation of the reverse/forward toggle switch 610 of FIG. 6.

Thus, the method 1000 may be used to separate tubing sleeves from a tubing holder. For example, each of the subsections of tubing 302 may correspond to a heat shrink tubing sleeve. The apparatus 600 may separate the tubing sleeves from the tubing holder 200 by using the traction wheel 400 to advance the tubing holder 200 to the cutting wheel assembly 500 and by using the cutting wheel assembly 500 to cut the section of tubing 208 at a plurality of locations. The tubing sleeves may be dispensed to an operator. Automatic separation of the tubing sleeves from the tubing holder may reduce cost and increase efficiency associated with using the tubing sleeves.

Figure 11:
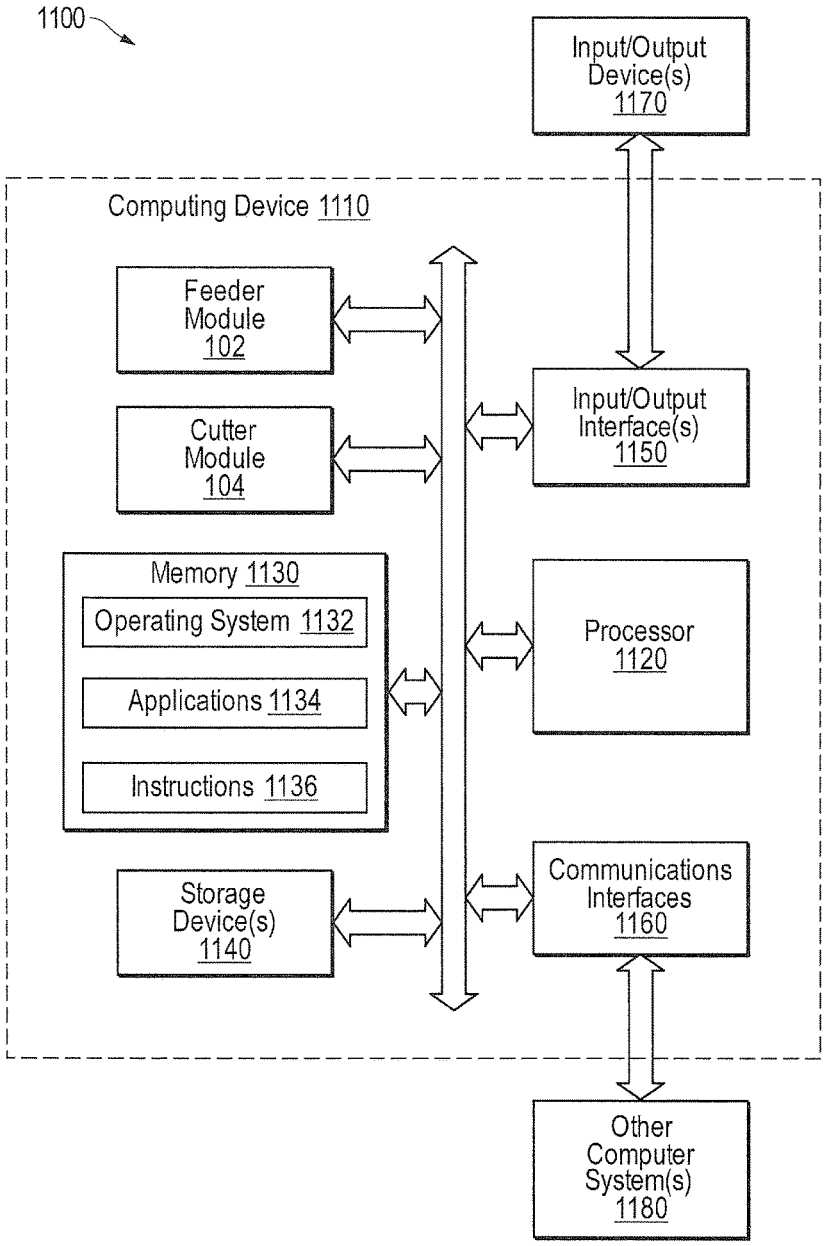
FIG. 11 is a block diagram of a particular illustrative embodiment of a computing environment to separate tubing sleeves from a tubing holder.

FIG. 11 is a block diagram of a computing environment 1100 including a general purpose computing device 1110 to support embodiments of computer-implemented methods and computer-executable program instructions (or code) according to the present disclosure. For example, the computing device 1110, or portions thereof, may execute instructions to control a tubing cutter apparatus to separate tubing sleeves from a tubing holder. As another example, the computing device 1110, or portions thereof, may execute instructions to use a feed system to feed a tubing holder toward a cutting system and to use the cutting system to cut a first section of tubing at a plurality of locations to separate a plurality of subsections of tubing. In a particular embodiment, the computing device 1110 may include, be included with, or correspond to the system 100 of FIG. 1, the apparatus 600 of FIGS. 6-7, the system 900 of FIG. 9, or a combination thereof.

The computing device 1110 may include a processor 1120. Within the computing device 1110, the processor 1120 may communicate with the feeder module 102 of FIG. 1, the cutter module 104 of FIG. 1, memory 1130, one or more storage devices 1140, one or more input/output interfaces 1150, one or more communications interfaces 1160, or a combination thereof.

The memory 1130 may include volatile memory devices (e.g., random access memory (RAM) devices), nonvolatile memory devices (e.g., read-only memory (ROM) devices, programmable read-only memory, and flash memory), or both. The memory 1130 may include an operating system 1132, which may include a basic/input output system for booting the computing device 1110 as well as a full operating system to enable the computing device 1110 to interact with users, other programs, and other devices. The memory 1130 may include one or more application programs 1134, such as a tubing sleeve separating system control application, e.g., an application that is executable to control a tubing cutter apparatus to separate tubing sleeves from a tubing holder. The memory 1130 may include instructions 1136 that are executable by the processor 1120, e.g., instructions that are executable to control a tubing cutter apparatus to separate tubing sleeves from a tubing holder.

The processor 1120 may also communicate with one or more storage devices 1140. For example, the one or more storage devices 1140 may include nonvolatile storage devices, such as magnetic disks, optical disks, or flash memory devices. The storage devices 1140 may include both removable and non-removable memory devices. The storage devices 1140 may be configured to store an operating system, applications, and program data. In a particular embodiment, the memory 1130, the storage devices 1140, or both, include tangible, non-transitory computer-readable media.

The processor 1120 may also communicate with one or more input/output interfaces 1150 that enable the computing device 1110 to communicate with one or more input/output devices 1170 to facilitate user interaction. For example, the one or more input/output devices 1170 may include the variable speed foot switch 902 of FIG. 9. The input/output interfaces 1150 may include serial interfaces (e.g., universal serial bus (USB) interfaces or Institute of Electrical and Electronics Engineers (IEEE) 11094 interfaces), parallel interfaces, display adapters, audio adapters, and other interfaces. The input/output devices 1170 may include keyboards, pointing devices, displays, speakers, microphones, touch screens, and other devices. The processor 1120 may detect interaction events based on user input received via the input/output interfaces 1150. Additionally, the processor 1120 may send a display to a display device via the input/output interfaces 1150.

The processor 1120 may communicate with other computer systems 1180 via the one or more communications interfaces 1160. The one or more communications interfaces 1160 may include wired Ethernet interfaces, IEEE 802 wireless interfaces, Bluetooth communication interfaces, or other network interfaces. The other computer systems 1180 may include host computers, servers, workstations, and other computing devices.

Thus, in particular embodiments, a computer system may be able to control a tubing cutter apparatus to separate tubing sleeves from a tubing holder. For example, the instructions 1136 may be executable by the processor 1120 to use a feed system to feed a tubing holder toward a cutting system and to use the cutting system to cut a first section of tubing at a plurality of locations to separate a plurality of subsections of tubing.

Embodiments described above are illustrative and do not limit the disclosure. It is to be understood that numerous modifications and variations are possible in accordance with the principles of the present disclosure.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the figures or one or more method steps may be omitted. Accordingly, the disclosure and the figures are to be regarded as illustrative rather than restrictive.

Moreover, although specific embodiments have been illustrated and described herein, it is to be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to less than all of the features of any of the disclosed embodiments.

What is claimed is:

1. An apparatus comprising:

a tubing holder configured to couple to a plurality of sections of tubing coupled at intervals along a first spine of the tubing holder and a second spine of the tubing holder;

a feed system configured to feed the tubing holder toward a cutting system, wherein the feed system comprises a traction wheel, and wherein the traction wheel comprises:

a plurality of projecting pins, and a plurality of grooves in the traction wheel, wherein each groove of the plurality of grooves is configured to provide a track in the traction wheel for a cutting blade of the cutting system, and wherein each section of the plurality of sections extends away from the first spine in a direction that is transverse to a feed direction of the feed system; and the cutting system, the cutting system including a number of cutting blades positioned with respect to the tubing holder to cut a first section of tubing of the plurality of sections at a plurality of locations to separate the first section into a plurality of subsections, wherein the plurality of subsections includes a first subsection, a second subsection, and a third subsection, and wherein:

the first spine is coupled to the first subsection after the first section is cut by the cutting system;

the second spine is coupled to the second subsection after the first section is cut by the cutting system, the first subsection distinct from the second subsection; and the first spine and the second spine are separated from the third subsection after the first section is cut by the cutting system.

2. The apparatus of claim 1, wherein the plurality of subsections includes a fourth subsection, wherein the tubing holder is separated from the fourth subsection after the first section is cut by the cutting system, and wherein the fourth subsection is distinct from the third subsection.

3. The apparatus of claim 1, wherein the first spine of the tubing holder includes a plurality of apertures, wherein one or more projecting pins of the plurality of projecting pins are configured to engage with one or more apertures of the plurality of apertures to feed the tubing holder toward the cutting system.

4. The apparatus of claim 1, further comprising an input device, wherein in response to input at the input device, the feed system advances the tubing holder by one section of the plurality of sections of tubing toward the cutting system.

5. The apparatus of claim 1, wherein the cutting system includes three or more cutting blades.

6. The apparatus of claim 5, wherein the three or more cutting blades are located on a shaft, wherein the three or more cutting blades extend radially outward from the shaft, and wherein the three or more cutting blades are arranged substantially parallel to each other.

7. The apparatus of claim 6, wherein a first cutting blade of the three or more cutting blades is located centrally on the shaft, wherein a second cutting blade of the three or more cutting blades is located a first distance from the first cutting blade along the shaft, and wherein a third cutting blade of the three or more cutting blades is located a second distance from the first cutting blade along the shaft.

8. The apparatus of claim 7, wherein the shaft comprises a central cutting wheel that includes a cutting engagement hole coupled to an electric motor.

9. The apparatus of claim 1, wherein the second spine is parallel to the first spine and is coupled to the plurality of sections of tubing at intervals along the second spine.

10. The apparatus of claim 9, wherein the tubing holder further comprises adhesive tape attaching a first end of the plurality of sections of tubing to the first spine and attaching a second end of the plurality of sections of tubing to the second spine.

11. The apparatus of claim 1, further comprising a toggle switch configured to reverse a feed direction of the feed system to remove the tubing holder.

12. An apparatus comprising:

a tubing holder configured to couple to a plurality of sections of tubing at intervals along a first spine of the tubing holder and a second spine of the tubing holder;

a cutting system, the cutting system comprising three or more cutting blades positioned with respect to the tubing holder to cut a first section, of the plurality of sections of tubing, at a plurality of locations to separate the first section of tubing into a plurality of subsections of tubing, wherein the first spine of the tubing holder includes a plurality of apertures, wherein the plurality of subsections includes a first subsection, a second subsection, and a third subsection, and wherein:

the first spine is coupled to the first subsection after the first section is cut by the cutting system;

the second spine is coupled to the second subsection after the first section is cut by the cutting system, the first subsection distinct from the second subsection; and the first spine and the second spine are separated from the third subsection after the first section is cut by the cutting system; and a feed system comprising a traction wheel including a plurality of projecting pins and a plurality of grooves in the traction wheel, wherein each groove of the plurality of grooves is configured to provide a track in the traction wheel for the three or more cutting blades, wherein one or more projecting pins of the plurality of projecting pins are configured to engage with one or more apertures of the plurality of apertures to feed the tubing holder towards the cutting system.

13. The apparatus of claim 12, wherein the tubing holder includes a plurality of sections of tubing along the first spine of the tubing holder, each section of the plurality of sections of tubing extending away from the first spine in a direction that is transverse to a feed direction of the feed system.

14. The apparatus of claim 12, wherein the three or more cutting blades are located on a shaft, wherein the three or more cutting blades extend radially outward from the shaft, and wherein the three or more cutting blades are arranged substantially parallel to each other.

15. The apparatus of claim 14, wherein the three or more cutting blades are positioned on the shaft perpendicular to the plurality of sections of tubing.

16. The apparatus of claim 12, further comprising a toggle switch configured to reverse a feed direction of the feed system to remove the tubing holder.

17. The apparatus of claim 12, wherein the plurality of grooves in the traction wheel are arranged to align with the three or more cutting blades.

18. The apparatus of claim 12, further comprising an input device, wherein in response to input at the input device, the feed system advances the tubing holder by one section of the plurality of sections of tubing toward the cutting system.

19. The apparatus of claim 13, wherein the second spine is parallel to the first spine and is coupled to the plurality of sections of tubing at intervals along the second spine.

20. The apparatus of claim 19, wherein the tubing holder further comprises adhesive tape attaching a first end of the plurality of sections of tubing to the first spine and attaching a second end of the plurality of sections of tubing to the second spine.

* * * * *